US005934519A

United States Patent [19]

Kim et al.

[11] Patent Number: 5,934,519

[45] Date of Patent: Aug. 10, 1999

[54] WEIGHTED DIP TUBE

[76] Inventors: Hee Soo Kim; John Kim, both of 2601 Berkshire Dr., San Bruno, Calif. 94066

[21] Appl. No.: 08/971,378

[22] Filed: Nov. 17, 1997

[51] Int. Cl.[6] ..... B67D 5/60

[52] U.S. Cl. ..... 222/464.4; 222/382

[58] Field of Search ..... 222/211, 382, 222/464.3, 464.4

[56] References Cited

U.S. PATENT DOCUMENTS

| | | | |
|---|---|---|---|
| 1,253,579 | 1/1918 | Deans . | |
| 1,887,013 | 11/1932 | Coffield | 222/464.4 X |
| 2,063,803 | 12/1936 | Gildersleeve . | |
| 3,088,680 | 5/1963 | Fulton et al. | 222/464.4 X |
| 3,667,655 | 6/1972 | Knieriem, Jr. | 222/464.4 |
| 4,069,950 | 1/1978 | Archer | 222/211 X |
| 4,273,272 | 6/1981 | Blanc | 222/464.4 |
| 4,305,521 | 12/1981 | Komatsuta | 220/90.2 |
| 4,892,187 | 1/1990 | Stein | 206/217 |
| 5,195,664 | 3/1993 | Rhea | 222/464.4 |
| 5,211,298 | 5/1993 | Bloch | 215/11.1 |
| 5,636,770 | 6/1997 | Hachinohe et al. | 222/464.4 X |

FOREIGN PATENT DOCUMENTS

| | | | |
|---|---|---|---|
| 1288381 | 2/1962 | France | 222/464.4 |
| 890789 | 3/1962 | United Kingdom | 222/464.4 |

*Primary Examiner*—Kevin P. Shaver
*Attorney, Agent, or Firm*—Goldstein & Canino

[57] ABSTRACT

A flexible straw, having a proximal end and a destal end. The flexible straw comprises a tube and a weight assembly that is located near the distal end. The flexible straw is used in a bottle containing a liquid having a fluid level. The bottle also has a lowest point which is determined by the angle at which the bottle is held. The weight assembly comprises interchangeable weight disks which are selected according to the viscosity of the liquid which is contained within the bottle.

5 Claims, 3 Drawing Sheets

WEIGHTED DIP TUBE

BACKGROUND OF THE INVENTION

The invention relates to a flexible straw. More particularly, the invention relates to a straw having a variable weight attached near its distal end, so that it can retrieve liquid from the lowest point of a container.

A variety of liquids are dispensed from bottles using straws. A "sport" bottle is a refillable container with a closable top. A straw extends through the top and to the bottom of the bottle. This arrangement makes the bottle well suited for drinking from the bottle while it is in the vertical position and when it is substantially full of liquid. However, when the bottle is almost empty and is tilted, the drinker cannot retrieve the liquid through the straw, since the liquid level is no longer at the bottom of the bottle. In fact, depending on the angle that the bottom is tilted, and the amount of liquid remaining, the liquid level may be near the top of the bottle.

Spray bottles similarly employ a straw like tube which extends to the bottom of the bottle. A pump draws liquid up through the straw and atomizes it to produce a spray. However, difficulty is encountered when one attempts to hold the bottle on an angle while spraying. This is particularly troublesome for cleaning solutions which are often dispensed in this manner. When cleaning one must often clean horizontal surfaces, necessitating that one tilt the bottle containing the cleaning solution to direct the spray at the horizontal surface. However, such tilting often prevents the liquid from being dispensed.

While these units may be suitable for the particular purpose employed, or for general use, they would not be as suitable for the purposes of the present invention as disclosed hereafter.

SUMMARY OF THE INVENTION

It is an object of the invention to produce a flexible straw which seeks the lowest level where a liquid is present in a bottle bearing the liquid, so that the liquid may be dispensed despite the angle of the bottle.

It is a further object of the invention that the straw is weighted at its distal end, to ensure that the straw reaches the lowest point.

It is a still further object of the invention that the weight is concentrated at the distal end by means of a removable weight. The weight is selected according to the viscosity of the liquid.

It is yet a further object of the invention that interchangeability of the weight is facilitated by providing a weight seat, and end cap, and proximal flange, which keep the weight positioned at a fixed location on the tube, but allow its easy removal.

The invention is a flexible straw, having a proximal end and a destal end. The flexible straw comprises a tube and a weight assembly that is located near the distal end. The flexible straw is used in a bottle containing a liquid having a fluid level. The bottle also has a lowest point which is determined by the angle at which the bottle is held. The weight assembly comprises interchangeable weight disks which are selected according to the viscosity of the liquid which is contained within the bottle.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
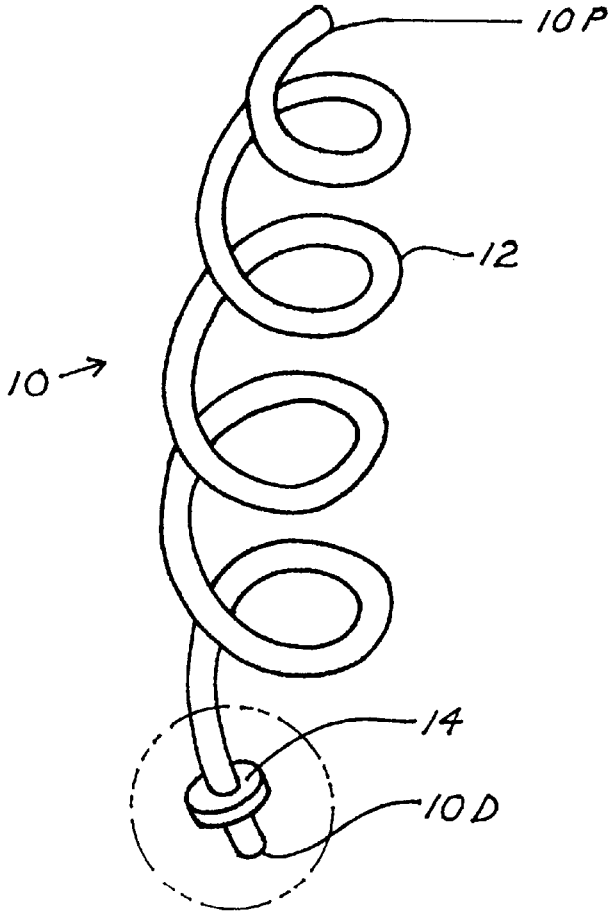
FIG. 1 is a diagrammatic perspective view, illustrating the invention per se.

FIG. 1 illustrates a straw 10 having a proximal end 10P and a distal end 10D. The straw 10 comprises a tube 12, and a weight assembly 14 near the distal end 10D. The tube 12 is flexible, and generally forms a coil.

Figure 2:
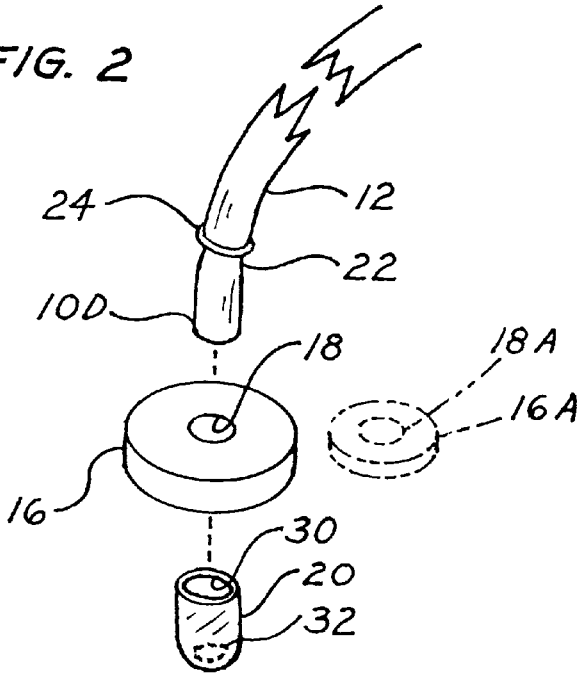
FIG. 2 is an assembly view, illustrating the various components of the weight assembly at the distal end of the invention.

Referring to FIG. 2, the weight assembly 14 comprises a weight disk 16 having a central bore 18 which is substantially the outside diameter of the tube 12. The weight disk is mounted on the tube 12 with the tube extending through the central bore 18. The weight assembly 14 further comprises an end cap 20, a weight recess 22, and a flange 24 which is just proximal of the weight recess 22.

The weight recess 22 is a location near the distal end 10 D where the weight disk 16 is normally held. The flange 24 is slightly larger in diameter than the central bore 18, thus preventing the weight recess 22 from further proximal motion along the tube 12.

Further, the end cap 20 is inserted onto the tube after the weight disk 16 is in place at the weight recess 22. The end cap is larger in diameter than the central bore 18. Thus the end cap 20 prevents the weight disk 16 from moving distally along the tube, and actually falling off the tube 12. The end cap 20 has an upper opening 30 which is substantially the diameter of the tube 12, allowing the end cap 20 to extend over the tube. The end cap 20 has a lower opening 32 which is smaller in diameter than the tube 12, thus preventing the tube from sliding through the end cap 20, but allowing fluid to enter the tube 12 from the distal end 10D.

Also illustrated is an alternate weight disk 16A which has a different mass than the weight disk 16. The alternate weight disk 16A has a central bore 18A that is the same diameter as the central bore 18 of the weight disk 16. Having different mass weight disks 16 and 16A is necessary for the interchangeability of the weight disks, for the reasons that will be discussed below.

Figure 3:
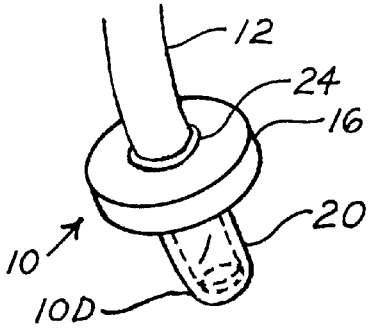
FIG. 3 is a diagrammatic perspective view, enlarged from the area of circle 3 in FIG. 1.

FIG. 3 illustrates the distal end 10D of the straw 10, wherein the weight disk 16 is installed on the tube 12 against the flange 24, and the end cap 20 is secured against the weight disk 16 opposite the flange 24.

Figure 4:
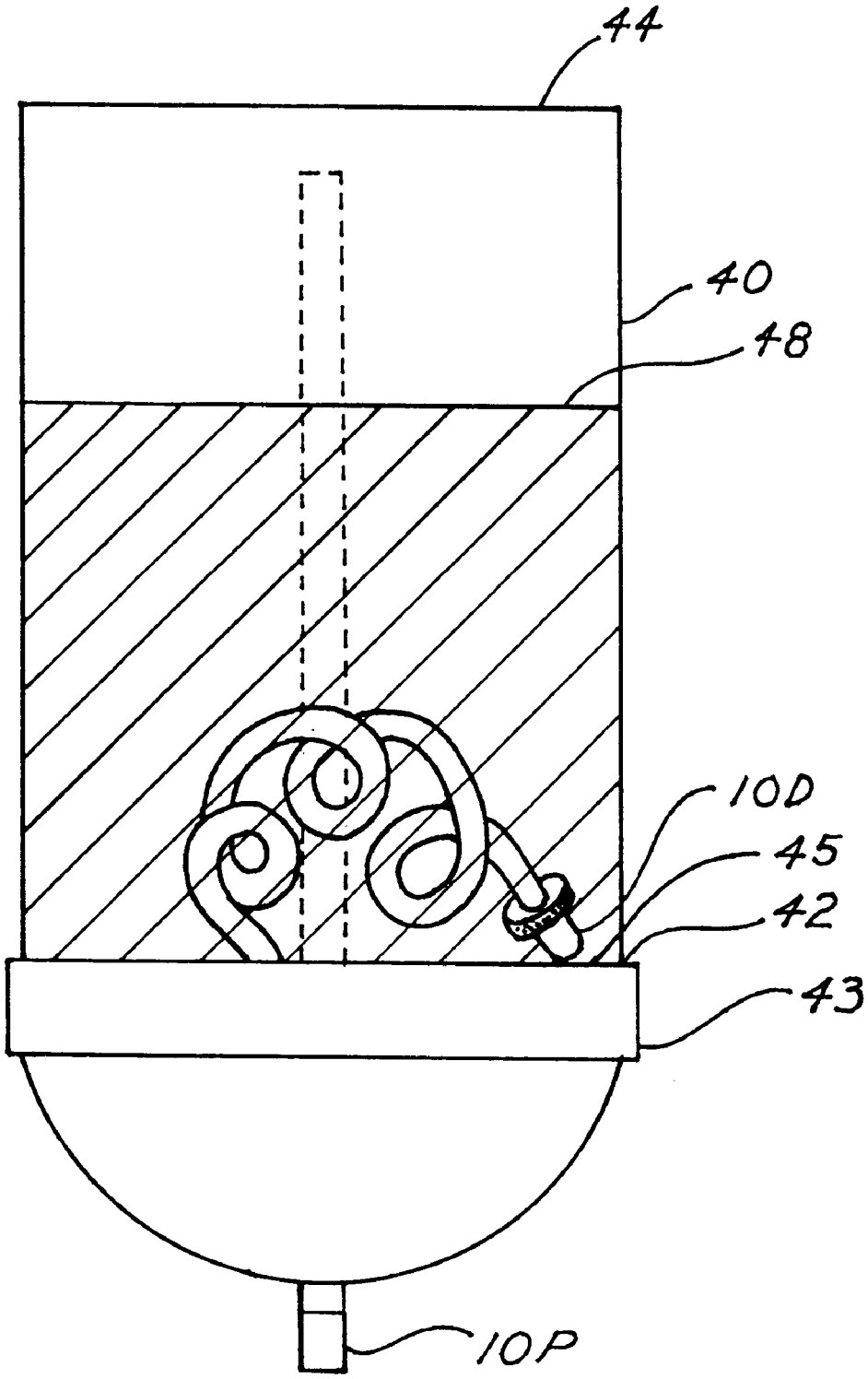
FIG. 4 is a front elevational view of the invention installed in one type of bottle, and in use.

Referring to FIG. 4, a bottle 40 is illustrated having a top 42 and a bottom 44. The bottle 40 has a lowest point 45, which is not necessarily the bottom 44, but depends on what angle the bottle is currently being held. A cap 43 is mounted at the top 42. Fluid 46 is contained within the bottle 40 and has a fluid level 48. The straw 10 extends through the cap 44, the proximal end 10P outside the bottle, and the distal end 10D located within the bottle. The distal end 10D of the straw is located at the lowest point 45 of the bottle, which is below the fluid level 48 as long as there is still liquid in the bottle. Weight provided by the weight disk ensures that the distal end 10D is at the lowest point 45 regardless of the angle of the bottle.

However, different weights should be used according to different liquid viscosity's. With more viscous liquids, a larger weight must be used to ensure that the weight provided by the weight disk is sufficient to bring the distal end 10D to the lowest point. However, a heavy weight is undesirable for a less viscous liquid, since the user will actually feel the weight moving around the bottle, which can be quite distracting.

Figure 5:
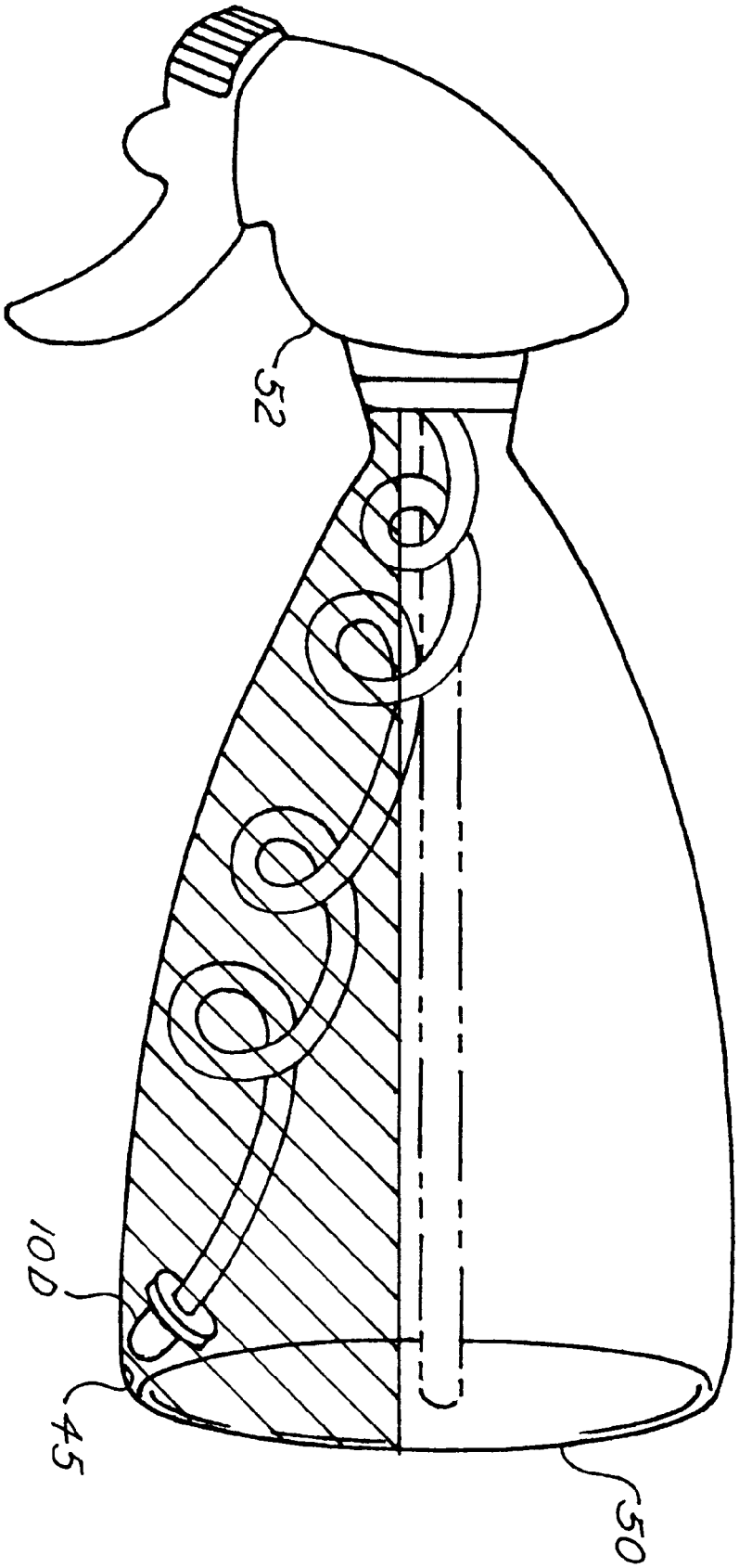
FIG. 5 is a front elevational view of the invention installed in a second type of bottle, and in use.

FIG. 5 illustrates a spray bottle 50 which includes a pump 52 at the proximal end 10P of the straw 10. Similarly, in such a bottle the pump 52 would not ordinarily operate when the spray bottle 50 is tilted. However, although the bottle is held horizontally here, the distal end 10D will reach the lowest point 45, allowing the bottle to be sprayed when at any angle, and even when the bottle is almost empty.

In conclusion, herein is presented a flexible straw, which has an interchangeable weight system near its distal end that allows the user to obtain liquid from a bottle, regardless of the angle of the bottle, and even when the bottle is almost empty.

What is claimed is:

1. A flexible straw, having a proximal end and a distal end, for use in a container having a fluid level and a lowest point defined by an angle at which the container is held, comprising:

a tube which is flexible, having an outside diameter; and a weight assembly near the distal end of the tube, for selectively allowing weights of different masses to be secured near the distal end of the tube for weighting the distal end of the tube so that it reaches the lowest point of the container at the angle it is held, comprising a weight disk having a central bore which is substantially the same in diameter as the outside diameter of the tube, the tube extends through the central bore, said weight assembly further comprising an end cap having a diameter larger then the central bore, also having a lower opening, and having an upper opening that is substantially the outside diameter of the tube.

2. The flexible straw as recited in claim 1, wherein the lower opening is smaller in diameter than the outside diameter of the tube.

3. The flexible straw as recited in claim 2, wherein the weight assembly further comprises a flange that is located proximal of the weight disk on the tube.

4. The flexible straw as recited in claim 3, wherein the weight assembly further comprises a weight recess in the tube near the distal end.

5. The flexible straw as recited in claim 4, wherein the flange is located just proximal of the weight recess.

* * * * *